United States Patent [19]

Degen

[11] 4,038,928

[45] Aug. 2, 1977

[54] LATERAL MAGNETIC TRUCK WHEEL POSITIONING ASSEMBLY

[75] Inventor: Norbert Degen, Munich, Germany

[73] Assignee: Maschinenfabrik Augsburg-Nurnberg AG, Germany

[21] Appl. No.: 457,215

[22] Filed: Apr. 1, 1974

[30] Foreign Application Priority Data

Mar. 30, 1973 Germany ..... 2315948

[51] Int. Cl.[2] ..... B61C 17/00; B61F 5/38; B61F 5/50; B61F 9/00

[52] U.S. Cl. ..... 104/242; 105/77; 105/157 R; 105/175 A; 105/215 R

[58] Field of Search ..... 104/148 LM, 242, 148 MS, 104/1 R, 1 A, 148 SS; 105/77, 78, 215 R, 1 R, 157 R, 175 A

[56] References Cited

U.S. PATENT DOCUMENTS

| | | | |
|---|---|---|---|
| 23,648 | 4/1859 | Vosmus | 105/77 |
| 443,677 | 12/1890 | Hunter | 105/77 |
| 671,482 | 4/1901 | Herkner | 105/78 |
| 867,147 | 9/1907 | Ochoa | 105/77 |
| 2,198,928 | 4/1940 | Wehner | 105/77 |
| 3,233,559 | 2/1966 | Smith et al. | 105/1 R |
| 3,630,153 | 12/1971 | Guimarin | 104/148 LM X |
| 3,934,183 | 1/1976 | Saufferer | 104/148 LM |

FOREIGN PATENT DOCUMENTS

| | | | |
|---|---|---|---|
| 643,316 | 4/1937 | Germany | 104/148 MS |
| 644,302 | 4/1937 | Germany | 104/148 MS |
| 707,032 | 6/1941 | Germany | 104/148 MS |

*Primary Examiner*—Albert J. Makay
*Assistant Examiner*—Howard Beltran
*Attorney, Agent, or Firm*—Craig & Antonelli

[57] ABSTRACT

Lateral guidance apparatus for laterally guiding a wheel set of a rail vehicle with respect to a support rail. The apparatus includes electromagnets carried with the wheel sets and positioned and controlled so as to effect return of the wheel set to a central position along the rail whenever the wheel set deviates from such central position. In a first preferred embodiment, the electromagnets are positioned at respective opposite sides of the rail supporting the vehicle wheels, with means for controlling the current in the electromagnets so that the magnetic force set up between the poles of the magnets and the support rail effects an automatic return of the wheel set to a desired central operating position. Some preferred embodiments include active control systems which vary the supply of electric current to the electromagnets as a function of the detected deviation of the wheel set from the central position on the rail, while other systems use passive control with constant supply of current to the electromagnets. In a preferred embodiment, the electromagnets, including the poles, are disposed above the support surface of the rail so as not to interfere with rail switching systems and the like.

10 Claims, 4 Drawing Figures

LATERAL MAGNETIC TRUCK WHEEL POSITIONING ASSEMBLY

BACKGROUND AND SUMMARY OF THE INVENTION

This invention relates to a device or apparatus for the lateral guidance of sets of wheels of rail vehicles.

The running gear or carriage unit of track-bound vehicles is required to provide a secure operating characteristic, a pleasant driving behavior, and a maximally low wear and tear on the wheels.

Mechanical running gears of rail vehicles are characterized by the fact that wheels are rolling along tracks. In conventional rail vehicles, the lateral guidance (rim guidance) is effected in most cases by means of a fixed set of wheels running on a track pair and having lateral flanges, or so-called rims. Upon the occurrence of lateral distubing forces (track flaws, side wind, and similar effects), so-called sinusoidal running manifests itself, due to an alternating contact of the rims with the two running tracks. Depending on the speed, the oscillation of the wheel set (sinusoidal oscillation) takes place more or less undamped, which leads to an unquiet running behavior, as well as a strong wear of the wheel sets.

In order to minimize this problem, various solutions have been attempted in the railroad car construction field, which solutions were used either individually or in combination with one another. Thus, the running surfaces of the wheels were, for example, made of a slightly conical shape, and the track running surfaces where inclined inwardly by the corresponding angle, whereby, in case of a lateral movement of the wheel set, due to the sloping drift (directional deviation along the incline), a restoring force became effective on the wheel set, leading the same back into the track position. In this connection, various profiles were utilized on the wheel sets, and various conical angles were likewise employed.

Furthermore, pivot mountings for the wheel sets have been developed, which were supported at the car body, in part, even in a rubber-elastic manner, whereby the lateral shocks caused by the contact of the rims against the tracks could be extensively prevented from affecting the car body. Also inclined wheels have been utilized to improve lateral guidance and thus reduce the sinusoidal movement.

All of the above-discussed mechanical steps, however, are extraordinarily expensive and are furthermore unsuitable for high-speed rail vehicles because of excessive wear and too unquiet an operating characteristic.

The present invention comtemplates providing apparatus for the lateral guidance of rail vehicles which is well suitable also for track-bound high-speed trains running between 120 and 240 m./h. (above 200 km./h. up to above 400 km./h.), which extensively excludes the undesired sinusoidal running characteristic, which is free of wear and tear and operates almost without inertia, and which is economical in price and also well suitable for subsequent incorporation into the wheel/rail system already existing in connection with present railroads.

More specifically, the present invention comtemplates apparatus which produces, by magnets attached to the wheel set, a magnetic field whereby, due to a force interaction between the magnetic poles, on the one hand, and one or more rail, on the other hand, the lateral guidance of the wheel set is accomplished without contact.

The solution provided by the present invention not only avoids the disadvantages occurring in heretofore known systems, but also proves to be particularly economical and eminently suitable for subsequent installation in all heretofore known wheel/rail systems (no high initial inventment costs for new routes and/or rail systems). The apparatus of the present invention is extensively maintenance-free and permits a completely functionally safe and wear-free lateral guidance even at maximum speeds. Additionally, the apparatus of this invention is quite particularly suitable for favorably influencing the sinusoidal running phenomenon and thereby increases the operating quietness. Furthermore, an increased economy is obtained in connection with the conveying means due to a reduction in servicing time and expenses.

In an advantageous embodiment of this invention, electromagnets are attached to the wheel set, which electromagnets are laterally offset with their pole faces with respect to one rail or both rails. Upon a lateral deviation of the magnet unit pertaining to a wheel set, these electromagnets produce electromagnetic forces with respect to the rail or rails, enforcing a return of the wheel set into the zero (initial, neutral) operating position. This can be effected either by an attracting force effect or also by a repelling force effect of the magnet poles on the rail(s) according to preferred embodiments of the invention.

In a further embodiment of the invention, the electromagnets are attached to the wheel set in such a manner that their pole faces are laterally directly beside the rail or rails. In this connection, the air gap present between magnets and rail can be kept at a very small value ($\geqq$ 5 mm.), which results in particularly large guiding forces with an only relatively minor expenditure in electrical energy.

In a further embodiment of this invention, the electromagnets are attached to the wheel set so that these electromagnets are disposed in their entirety above the running surface of the rail. Thereby, it is ensured that the guiding system can pass over switches without any problems.

In a further embodiment of this invention, the magnets attached to the wheel set exert a force effect with their poles on one or several especially installed guide rails. Thereby, the lateral guidance can be accomplished independently of the operating support rails. This results in certain cases of application in a lowering of the costs and/or in simplifications in installation.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
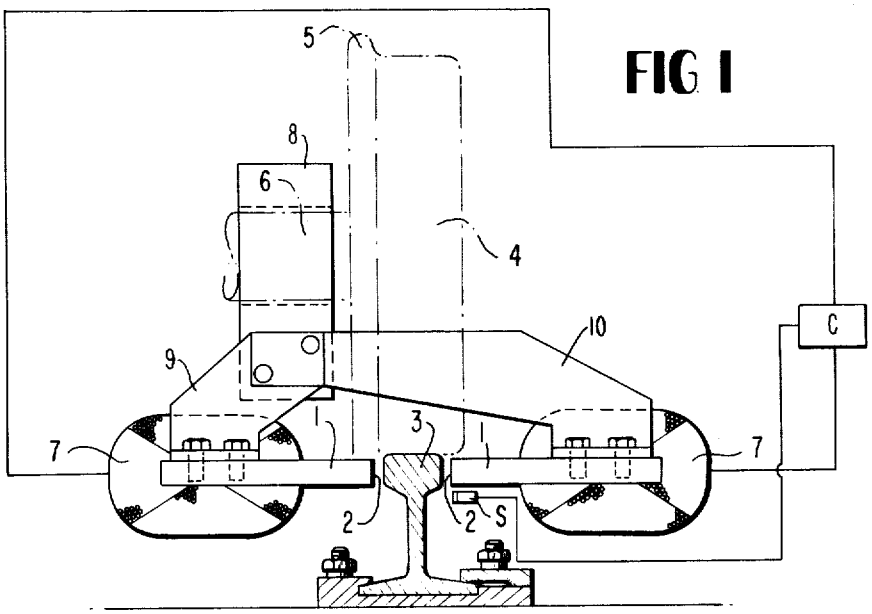
FIG. 1 is a schematic sectional view taken at right angles to a vehicle travel direction of a first preferred embodiment of lateral guidance apparatus constructed in accordance with the present invention.
Figure 2:
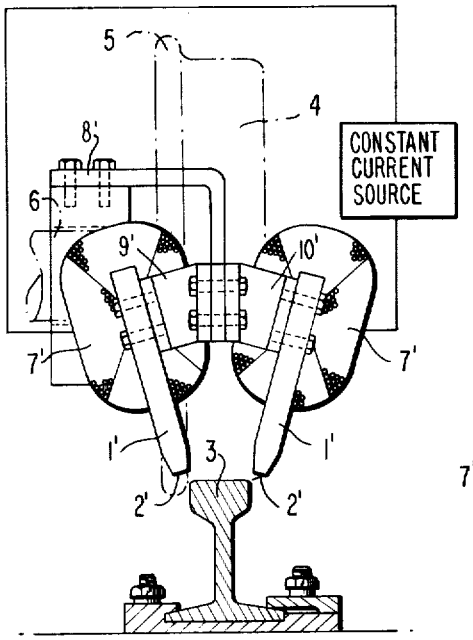
FIG. 2 is a view similar to FIG. 1 which shows a second preferred embodiment of laateral guidance apparatus constructed in accordance with the present invention.

In FIGS. 1 and 2, the guide magnets 1, 1' disposed respectively laterally of the rail 3 with their pole faces 2, 2' are fixedly joined with the wheel set (4, 5, 6) of the rail vehicle by members 9 and 10, respectively, connected by bolts or the like to a frame 8 which fits on the wheel axle 6 in FIG. 1. Details of the rail vehicle are not included since such can be of known construction, for example with plural wheel sets at each of two lateral sides in rolling engagement with a pair of paralle support rails 3. Only respectively one wheel 4 with the rim 5 and a part of the axle 6 pertaining thereto are illustrated in the Fgiures with regard to the rail vehicle. The use of wheels 4 with rims 5 serves as an emergency lateral guidance in case the energy supply to the electromagnets 1 should fail. Otherwise, the rims 5 are not utilized for a lateral guidance of the wheel set.

Upon a lateral deflection or deviation of the wheel sets from the rail (measured, for example, by sensors schematically depicted at S in FIG. 1), a larger amount of current is fed, via a suitable control means C to the electromagnet moving away from the rail 3, via the coils 7, than is fed to the magnet which approaches the rail 3. This different current supply provides that a larger attractive force is produced between the magnet moving away from the rail 3 and the rail 3, than between the rail 3 and the other magnet, whereby the wheel set connected to the magnets 1 is forced to return into its undisturbed initial position. Analogously, the magnets 1 could also be connected and switched so that they exert repelling forces on the rail 3, wherein the mgnets 1 are then controlled so that the magnet approaching the rail 3 exerts a greater repelling force than the magnet which moves away; in this connection, it is necessary to provide a magnetic polarity for the rail.

While the magnet arrangement ilustrated in FIG. 2 can pass completely over switches in the rail system because the electromagnets 1 are arranged at the wheel set so that they are disposed in their entirety above the running surface of the rail, the magnet arrangement shown in FIG. 1 must be pulled upwardly when switches are passed, because in this case (FIG. 1) the pole faces 2 of the magnets 1 are arranged directly laterally beside the rail 3 below the upper support surface of rail 3.

The control of the electromagnets 1 can be conducted in an "active" as well as (particularly advantageously) in a "pawsive" manner in accordance with preferred embodiments of the invention.

In case of an active control (as described, for example, hereinabove), the current flowing through the field (magnet) coils 7 and thus the size of the attractive force is controlled in dependence on the position of the pole faces 2 with respect to the rail 3.

In case of a passive control such as shown in FIG. 2, a constant current flows through the magnet coils 7, independently of the position of the pole faces 2 with regard to the rail 3. Control devices as well as sensors to measure lateral deviations from the zero position are eliminated in this arrangement, because the magnet system 1 is designed so that it always adjsuts itself symmetrically with respect to the guide rail 3, which can be accomplished especially advantageously by electrodynamic means.

The magnet arrangements illustrated in FIGS. 1 and 2 are suitable for active as well as passive control.

Figure 3:
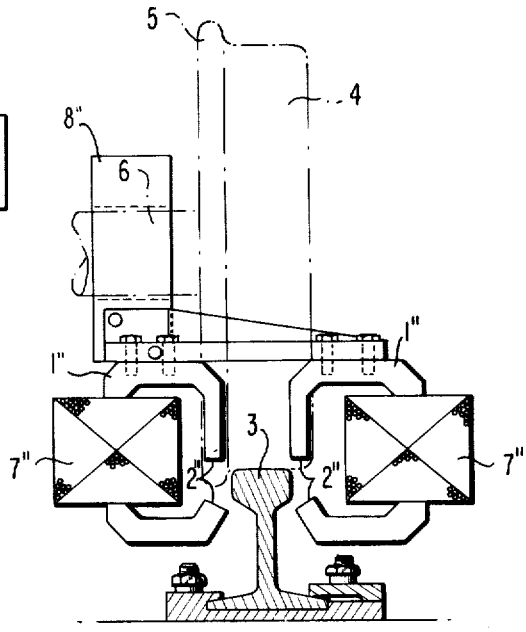
FIG. 3 is a view similar to FIG. 1 which shows a third preferred embodiment of lateral guidance apparatus constructed in accordance with the present invention.

FIG. 3 shows another magnet arrangement, also suitable for active as well as passive regulation. In this embodiment, two C-shaped electromagnets 1" (with magnet coils 7") encompass the rail 3 on both sides so that the pole faces 2" are disposed laterally above and below the rail head, these electromagnets being arranged at right angles to the longitudinal direction of the rails.

Figure 4:
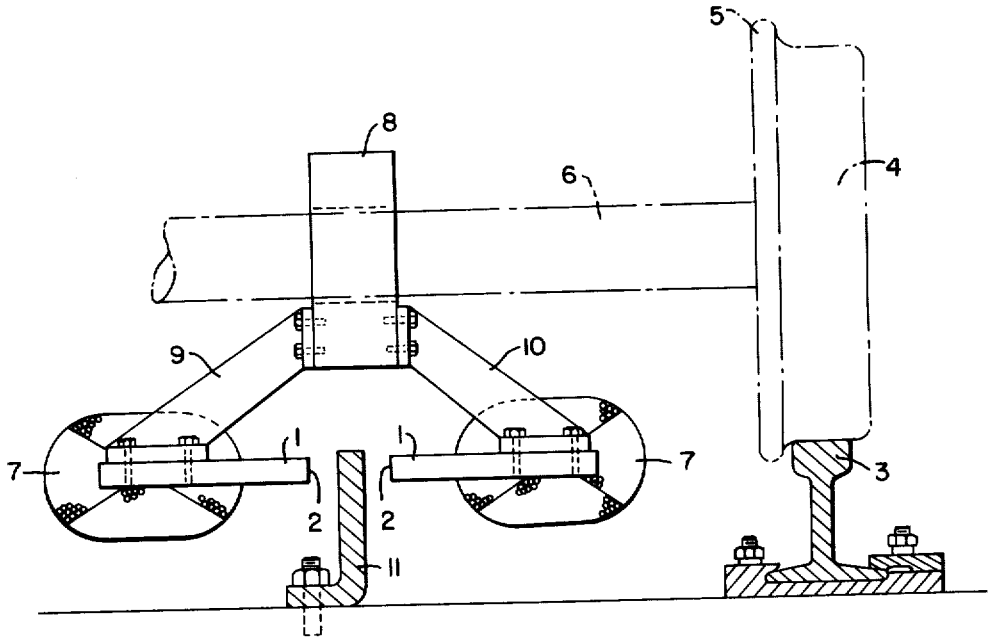
FIG. 4 is a view similar to FIG. 1 which shows a fourth preferred embodiment of lateral guidance apparatus constructed in accordance with the present invention.

However, the invention is not limited to the embodiments illustrated in the drawings; rather, the idea of the present invention can be realized by still another plurality of magnet systems. Thus, it is contemplated by the present invention, for example, to arrange the magnets so that they exert forces on an additional guide rail or steering track 11 as shown in FIG. 4, rather than on one or both operating support rails. It is also contemplated by this invention to provide that the magnets are effective only on the mutually facing inner sides of the two operating support rails, or only on the respective external sides of such rails.

It will be understood that the magnet control system described above in connection with FIG. 1 is to be similarly constructed for the embodiments of FIGS. 2, 3 and 4.

In preferred embodiments of the present invention, two magnets are provided on every side of a wheel set, with each magnet delivering a correction force of 300 to 500 kiloponds. The magnetic field intensity for such a correction force is one Tesla = 10,000 gauss per magnet; i.e. 1 kiloponds per square centimeter of the poles. Depending upon the core used for a given magnet, approximately 2.5 kilowatts per magnet is required for this field intensity. The average space between the rail and the pole of the magnet is preferably 6 mm. is a maximum spacing of 12 mm.

The embodiment of FIG. 1 is a particularly advantageous for low speeds in the range of up to 50 mph. in that is is the most efficient of the three illustrated embodiments at such low speed. In this FIG. 1 embodiment, the poles are arranged one after the other in the direction of motion.

The FIG. 2 embodiment has the lowest efficiency of the three illustrated embodiments, but is able to advantageously avoid rail switches without the need for changing the position of the magnets during use.

The FIG. 3 embodiment exhibits a medium efficiency at low speeds however the highest efficiency of the three embodiments at high speeds in excess of 50 mph.

In the above-mentioned passive control system, the deviation of the magnet relative to the rail effects increasing lateral forces in the correcting direction without changing the current in the magnetic coils. For example, in case of a rail being permanently magnetic and the magnetic poles of the device being repelled by the pole of said rail. In the arrangement of FIG. 2, a deviation between the poles and the rails, a deviation or movement of the poles with respect to the rail so as to place only one of the poles above the rail, the lateral correction would be effected by the other pole only until the magnet is forced back into the position as shown in FIG. 2 so that both poles can effect respective contrary lateral forces.

While I have shown and described several embodiments in accordance with the present invention, it is understood that the same is not limited thereto but is susceptible of numerous changes and modifications as would be known to those skilled in the art and I therefore do not wish to be limited to the details shown and described herein but intend to cover all such changes and modifications as are encompassed by the scope of the appended claims.

I claim:

1. Lateral guidance apparatus for laterally guiding a wheel set of a rail vehicle as wheel means of the wheel set travel in a longitudinal direction along a support rail; said apparatus comprising:

magnet means and magnet support means for supporting said magnet means of said wheel set such that magnet pole means of the magnet means are disposed laterally directly beside the support rail and below an upper wheel support surface of said support rail and the force interaction between the magnet pole means and support rail effects lateral guidance of said wheel set with respect to said support rail so as to maintain spacing between said magnet means and said support rail.

2. Apparatus according to claim 1, wherein said magnet means include electromagnets positioned at and spaced laterally from respective opposite lateral sides of said support rail, said electromagnets being configured and controlled such that any deviation in lateral position of said wheel set with respect to a neutral central position along said support rail is automatically counteracted by electromagnetic forces exerted by said electromagnets on said wheel set and support rail.

3. Apparatus according to claim 2, wherein a passive congtrol system is provided for said electromagnets with constant current being supplied to the magnet coils thereof.

4. Apparatus according to claim 2, wherein an active control system is provided for said electromagnets with changes in current supplied to the magnet coils being dependent on the change in lateral spacing of the pole means from said support rail.

5. Apparatus according to claim 4, wherein said control system includes detecting means for detecting the lateral spacing of said pole means and support rail.

6. Apparatus according to claim 2, wherein said electromagnets are of C-shaped cross-section as seen in the travel longitudinal direction and are positioned so that the facing pole faces of each electromagnet are disposed respectively laterally above and below the upper support surface of the support rail.

7. Lateral guiding apparatus for laterally guiding a wheel set of a rail vehicle as wheel means of the wheel set travel in a longitudinal direction along a support rail; said apparatus comprising:

magnet means which include electromagnets spaced in the longitudinal direction from the wheel set and configured and controlled such that any deviation in lateral position of said wheel set with respect to a neutral central position along said support rail is automatically counteracted by electromagnetic forces exerted by said electromagnets on said wheel set and support rail, and magnet support means wherein said electromagnets are supported at the wheel set in such a manner that the magnet pole means are disposed in their entirety above the upper wheel support sursface of said support rail such that force interaction between said electromagnets and support rail effects lateral guidance of said wheel set with respect to said support rail so as to maintain spacing between said electromagnets and support rail.

8. Apparatus according to claim 7, wherein said magnet pole means extend downardly at an acute angle with respect to the vertical in facing relationship to respective opposite lateral sides of said support rail.

9. Lateral guiding apparatus for laterally guiding a wheel set of a rail vehicle as wheel means of the wheel set travel in a longitudinal direction along a support rail; said apparatus comprising:

magnet means and magnet support means for supporting said magnet means of said wheel set such that magnet pole means of the magnet means are disposed laterally directly beside a guide rail means, wherein said guide rail means includes a guide rail separate from and parallel to said support rail, for effecting lateral guidance of said wheel set with respect to said support rail so as to maintain a spacing between said magnet means and said guide rail means.

10. Apparatus according to claim 9, wherein said magnet means include electromagnets positioned at and spaced laterally from respective opposite lateral sides of said guide rail means, said electromagnets being configured and controlled such that any deviation in lateral position of said wheel set with respect to a neutral central position along said support rail is automatically counteracted by electromagnetic forces exerted by said electromagnets on said guide rail means.

* * * * *